US009919721B2

(12) United States Patent
Chen et al.

(10) Patent No.: US 9,919,721 B2
(45) Date of Patent: Mar. 20, 2018

(54) FRONT SUSPENSION SYSTEM HAVING OVERLOAD PROTECTION

(71) Applicants: QINGDAO SIFANG ROLLING STOCK RESEARCH INSTITUTE CO., LTD., Qingdao (CN); QINGDAO SRI TECHNOLOGY CO., LTD., Qingdao (CN)

(72) Inventors: Kai Chen, Qingdao (CN); Hui Liu, Qingdao (CN); Jibo Liu, Qingdao (CN)

(73) Assignees: QINGDAO SIFANG ROLLING STOCK RESEARCH INSTITUTE CO., LTD., Shandong (CN); QINGDAO SRI TECHNOLOGY CO., LTD., Shandong (CN)

( * ) Notice: Subject to any disclaimer, the term of this patent is extended or adjusted under 35 U.S.C. 154(b) by 678 days.

(21) Appl. No.: 14/399,505

(22) PCT Filed: May 6, 2013

(86) PCT No.: PCT/CN2013/075185

§ 371 (c)(1),
(2) Date: Nov. 6, 2014

(87) PCT Pub. No.: WO2013/185510

PCT Pub. Date: Dec. 19, 2013

(65) Prior Publication Data

US 2015/0114921 A1 Apr. 30, 2015

(30) Foreign Application Priority Data

Jun. 13, 2012 (CN) ..... 201220275520.X

(51) Int. Cl.

| | |
|---|---|
| ***B61G 3/04*** | (2006.01) |
| ***B61G 9/22*** | (2006.01) |
| ***B61G 7/10*** | (2006.01) |

(52) U.S. Cl.
CPC ..... *B61G 3/04* (2013.01); *B61G 7/10* (2013.01); *B61G 9/22* (2013.01)

(58) Field of Classification Search
CPC . B61G 1/00; B61G 1/28; B61G 1/286; B61G 3/00; B61G 3/02; B61G 3/04; B61G 9/00; B61G 9/04; B61G 11/00
See application file for complete search history.

(56) References Cited

U.S. PATENT DOCUMENTS 4,064,998 A * 12/1977 Dilg ..... B61G 7/10 213/12
5,285,911 A 2/1994 Altherr ..... 213/152

FOREIGN PATENT DOCUMENTS

CN 2698670 Y 5/2005
CN 201376574 Y 1/2010
(Continued)

OTHER PUBLICATIONS

International Search Report of corresponding International PCT Application No. PCT/CN2013/075185, dated Aug. 15, 2013.
(Continued)

*Primary Examiner* — Robert J McCarry, Jr.
(74) *Attorney, Agent, or Firm* — J.C. Patents

(57) ABSTRACT

Disclosed is a front suspension system having overload protection. The system comprises a mounting seat, a centering device, a support device used for supporting a coupling buffer and a coupling end pin, wherein the mounting seat is connected to a railway vehicle body, and the centering device and the support device are both installed on the mounting seat. The system further has a coupling connection seat and an overload protection element, wherein the coupling connection seat comprises a base and a coupling connection part connected as one with the base. The base is connected to a rear face of the mounting seat by means of the overload protection element. The coupling connection part
(Continued)

passes through a through hole provided in the middle of the mounting seat and is connected with the coupling buffer by means of the coupling end pin. The coupling connection part is closely fitted with the through hole. The front suspension system has a simple structure and is lightweight.

4 Claims, 3 Drawing Sheets

(56) References Cited

FOREIGN PATENT DOCUMENTS

| | | | |
|---|---|---|---|
| CN | 101879906 | A | 11/2010 |
| CN | 201792867 | U | 4/2011 |
| CN | 102390397 | A | 3/2012 |
| CN | 202624260 | U | 12/2012 |
| DE | 3610567 | A1 | 10/1987 |
| DE | 3931171 | A1 | 4/1991 |
| EP | 2 085 285 | A1 | 8/2009 |
| JP | H07-102811 | B2 | 11/1995 |
| JP | 2012-081934 | A | 4/2012 |
| JP | 2013-086652 | A | 5/2013 |
| RU | 330060 | A1 | 2/1972 |
| RU | 139341 | A1 | 11/1996 |
| RU | 2 438 899 | C2 | 1/2012 |

OTHER PUBLICATIONS

The Russian Decision on Grant of corresponding Russia patent application No. 2015100252/11(000492), dated Feb. 2, 2016.
The extended European Search Report of corresponding European application No. 13804691.7-1754, dated Dec. 23, 2015.
The Japanese Notification of Grant of corresponding Japan application No. 2015-513000, dated May 10, 2017.
The Russian Notification of Grant of corresponding Russian Federation application No. 2015100252/11(000492), dated Feb. 2, 2016.

* cited by examiner

FRONT SUSPENSION SYSTEM HAVING OVERLOAD PROTECTION

CROSS-REFERENCE TO RELATED APPLICATION

This application is a national phase application of international application No. PCT/CN2013/075185 filed on May 6, 2013, which in turn claims the priority benefits of Chinese application No. 201220275520.X filed on Jun. 13, 2012. The contents of these prior applications are hereby incorporated by reference in its entirety.

TECHNICAL FIELD

The invention relates to the field of a railway vehicle coupling buffer, in particular to a coupling buffer requiring for realization of overload protection in case of greater longitudinal force applied.

BACKGROUND OF THE INVENTION

As one of basic components of a railway vehicle, the coupling buffer has the advantages of rapidly connecting and disconnecting railway vehicles, transmitting vehicle tractive force, improving vehicle safety and comfortability.

The coupling buffer essentially comprises a coupling device, a squashing device, a buffer device, a front suspension device and an overload protection device. The coupling device has the function of connecting and disconnecting railway vehicles; the squashing device has the function of protecting vehicle body and passenger safety in emergency; as a coupling buffer, the buffer device has the function of improving the longitudinal impulse performance and vehicle safety and comfortability; fixing a coupler onto the vehicle body by means of the mounting seat, the front suspension device guarantees that the coupling buffer can flexibly rotate within certain limits in the horizontal plane and vertical plane, and has the functions of self-support in the vertical plane and automatic centering within certain limits in the horizontal plane; when railway vehicles suffer from great longitudinal impact, the overload protection device facilitates the coupling buffer to separate from vehicles, and further facilitates other energy absorbing devices on vehicles to come into play. As an important energy absorbing device in the coupling buffer, the buffer mainly takes part in longitudinal energy absorption in the normal running process of railway vehicles. Many existing buffers realize the function of energy absorption by means of compressing internal elastic components, while a buffer itself is connected to the mounting seat by means of a rotation axle so as to realize the function of rotation of the coupling buffer. The mounting seat is connected to vehicle body by means of an erection bolt or the overload protection device so as to transmit longitudinal load.

At present, commonly the overload protection device is arranged on the outside of the coupling buffer, directly connecting the coupling buffer with vehicle body, and facilitates the coupling buffer to separate from the vehicle body once it comes into play. The existing coupling buffer of railway vehicles essentially comprises a front suspension system and a buffer system. There are three methods for realization of the overload protection function of the buffer: the first method is to break the connection between the mounting seat and the vehicle body, the second method is to equip the buffer shell with a shear pin so as to realize retreat of a buffer core in a coupler body by destroying the shear pin, and the third method is to break the connection between the mounting seat and the coupling buffer. At present the first method is widely used because of easy realization, but requires for a small-sized mounting seat and buffer or enough space left under the vehicle body so that the whole coupling buffer separates from the vehicle body and retreats. However, restricted by the existing structure and strength, the opening size of the chassis of the vehicle body is difficult to enlarge. However, a high-performance buffer device requires for larger space left for retreating, which greatly restricts the application scope of the first method for realization of overload protection function. The second method has the disadvantage of uneven stress of the shear pin, unavailable for good realization of overload protection; besides, the space for retreat of the coupling buffer is influenced by the total length of the coupling buffer, often unable to provide enough space for safely retreating.

SUMMARY OF THE INVENTION

In allusion to the above-mentioned disadvantages of the existing coupling buffer of railway vehicles for overload protection, the invention provides a front suspension system having overload protection, which has the advantages of simple structure, light weight, good stability and high reliability; the system integrates the front suspension system and the overload protection device, and allows the coupling buffer to be connected to the vehicle body without installation of an adapter plate. Therefore, the system is light in weight and simpler in structural design of the vehicle body.

The technical scheme of the invention is as below: a front suspension system having overload protection comprises a mounting seat, a centering device, a support device used for supporting a coupling buffer and a coupling end pin, wherein the mounting seat is connected to a railway vehicle body, and the centering device and the support device are both installed on the mounting seat; the system further has a coupling connection seat and an overload protection element, wherein the coupling connection seat comprises a base and a coupling connection part connected as one with the base, the base is connected to a rear face of the mounting seat by means of the overload protection element, the coupling connection part passes through a through hole provided in the middle of the mounting seat and is connected with the coupling buffer by means of the coupling end pin; and the coupling connection part is closely fitted with the through hole.

Preferentially, the through hole positioned in the middle of the mounting seat is a cylindrical through hole, the coupling connection part is cylindrical, and the inner diameter of the through hole is equal to the outer diameter of the coupling connection part.

Preferentially, the overload protection element uses four snap bolts.

Beneficial effects of the invention: the invention is simple in structure, stable and reliable, and space-saving, integrating the front suspension system and the overload protection device into a whole, allowing the coupling buffer to be connected to the vehicle body without installation of the adapter plate, thus the structural design of the vehicle body is simplified, and the system is light in weight; the mounting seat is connected with a vehicle body connecting base by means of the overload protection element, which ensures a simpler structure and more even stress compared with the formal structure of the shear pin; the mounting seat is provided with a through hole, after the overload protection element comes into play, both the coupling buffer and the coupling connection seat break away from the mounting seat and move backward under the guidance of the through hole, which ensures better stability and reliability than existing products; besides, space under the vehicle body is used when the overload protection element works, without retreat space provided by the coupling buffer, which is convenient for optimal design in case of a certain total length of the coupler, thus being applicable for a coupling buffer of large capacity and large stroke.

DETAILED DESCRIPTION OF THE EMBODIMENTS

Figure 1:
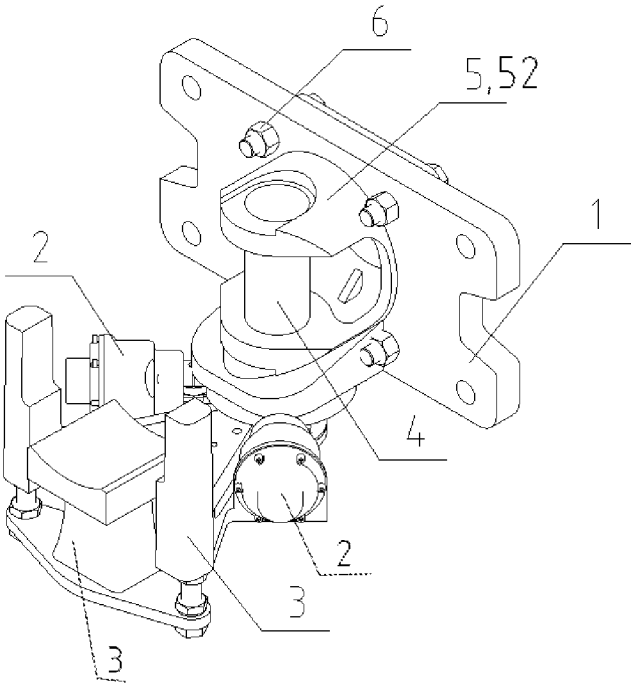
FIG. 1 is a front perspective view of an embodiment of the invention.
Figure 2:
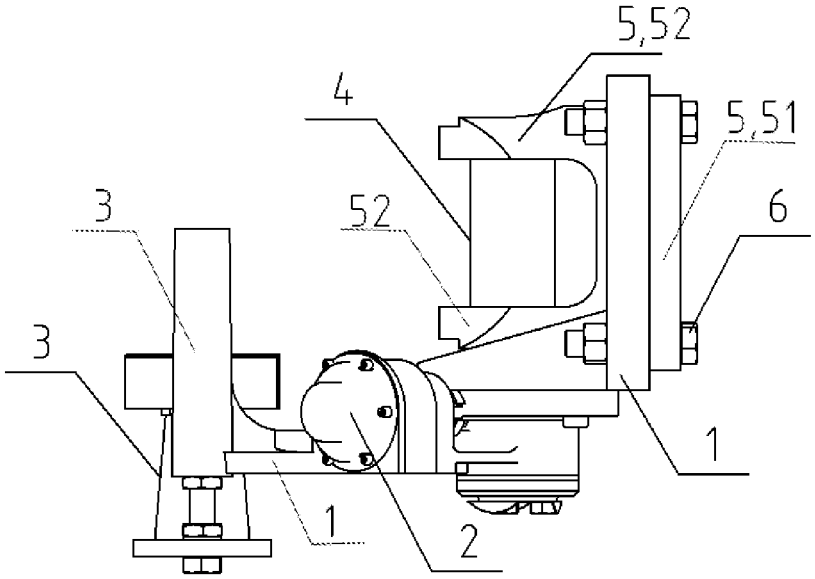
FIG. 2 is a right side view of an embodiment of the invention.
Figure 3:
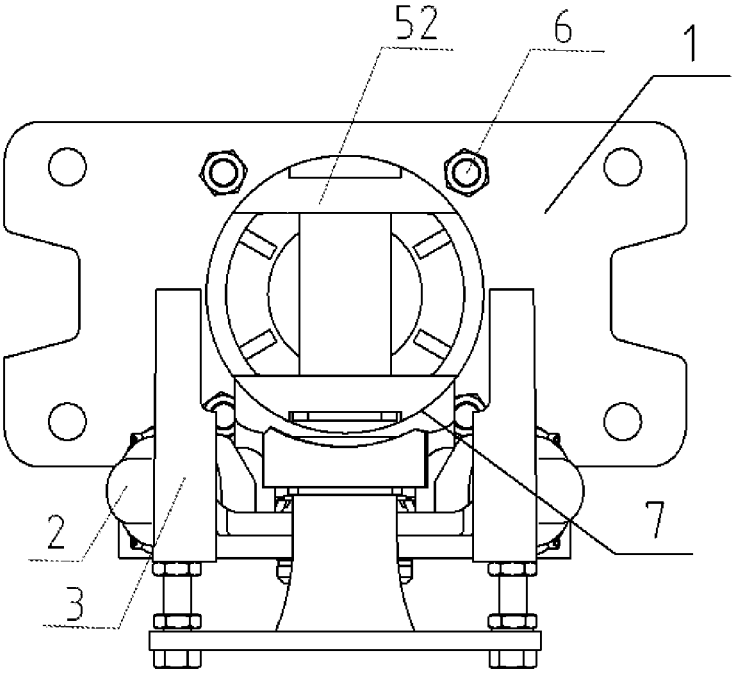
FIG. 3 is a front view of an embodiment of the invention.
Figure 4:
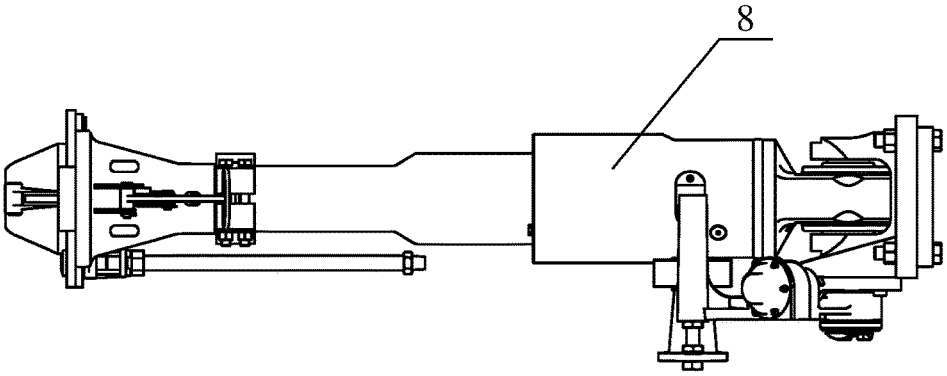
FIG. 4 is a state diagram of the coupling buffer before the overload protection element comes into play in an embodiment of the invention.
Figure 5:
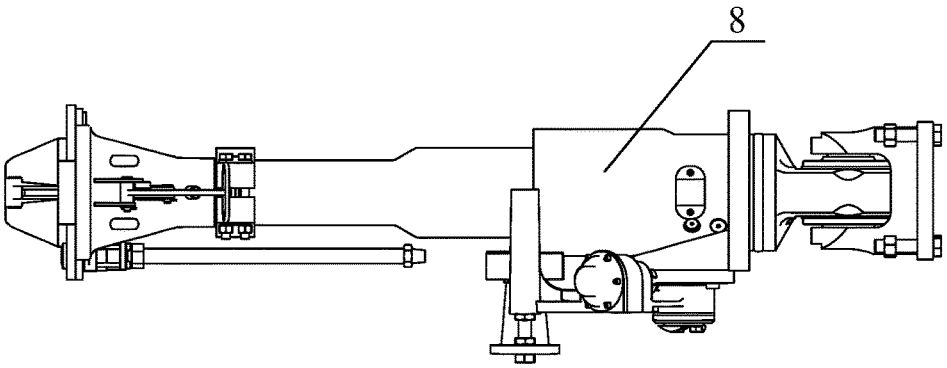
FIG. 5 is a state diagram of the coupling buffer after the overload protection element comes into play in an embodiment of the invention.

Further description of the invention is made in combination with the accompanying drawings.

Disclosed is a front suspension system having overload protection. The system comprises a mounting seat 1, a centering device 2, a support device 3 used for supporting a coupling buffer 8 and a coupling end pin 4, wherein the mounting seat 1 is connected to a railway vehicle body, and the centering device 2 and the support device 3 are both installed on the mounting seat 1. The system further has a coupling connection seat 5 and an overload protection element 6, and is provided with a cylindrical through hole 7, wherein the coupling connection seat 5 comprises a base 51 and a coupling connection part 52 connected as one with the base 51, the coupling connection seat 5 is cylindrical, the base 51 is connected to a rear face of the mounting seat 1 by means of the overload protection element 6; the coupling connection part 52 passes through the cylindrical through hole 7 provided in the middle of the mounting seat 1 and is connected with the coupling buffer 8 by means of the coupling end pin 4; the outer diameter of the coupling connection part 52 is equal to the inner diameter of the cylindrical through hole 7 provided in the middle of the mounting seat 1, and the coupling connection part 52 is closely fitted with the cylindrical through hole 7 provided in the middle of the mounting seat 1. The overload protection element 6 uses four snap bolts.

The working principle: components in front of the coupler transmit load to the coupling buffer, and the coupling buffer is restricted by the coupling connection seat and the coupling end pin, thus being compressed; the overload protection element fails in case the compression load exceeds its design value, namely, four snap bolts are fractured, thus the connection between the coupling connection seat and the mounting seat is broken, so the coupling connection seat separates from the mounting seat, and the anticreeper and vehicle body energy absorption area of a vehicle impacted come into play; at this moment, both the vehicle body connecting base and the coupling buffer enter into the space under the vehicle body through the mounting seat, and continue to move backward under the action of impact load. Tractive force directly compresses the elastic component in the coupling buffer and is transmitted to the coupling connection seat, the mounting seat and the vehicle body in case the tractive force is applied to the coupler, and in this process the overload protection element bears no force.

What is claimed is:

1. A front suspension system having overload protection comprising a mounting seat, a centering device, a support device for supporting a coupling buffer and a coupling end pin, wherein the mounting seat is connected to a railway vehicle body, and the centering device and the support device are installed on the mounting seat; wherein the system further comprises a coupling connection seat and an overload protection element, the coupling connection seat comprises a base and a coupling connection part connected with the base; the base is connected to a rear face of the mounting seat by the overload protection element which is breakable under an overload; the coupling connection part passes through a through hole provided in a central portion of the mounting seat and is connected with the coupling buffer by the coupling end pin; the coupling connection part is tightly fitted with the through hole.

2. The front suspension system having overload protection according to claim 1, wherein the through hole positioned in the central portion middle of the mounting seat is a cylindrical through hole, the coupling connection part is of a cylindrical shape, and an inner diameter of the through hole is equal to an outer diameter of the coupling connection part.

3. The front suspension system having overload protection according to claim 1, wherein the overload protection element comprises four snap bolts.

4. The front suspension system having overload protection according to claim 2, wherein the overload protection element comprises four snap bolts.

* * * * *